US006857370B1

(12) United States Patent
May

(10) Patent No.: US 6,857,370 B1
(45) Date of Patent: Feb. 22, 2005

(54) PRIMER BODY

(75) Inventor: Herbert D. May, Valrico, FL (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 0 days.

(21) Appl. No.: 10/411,595

(22) Filed: Apr. 10, 2003

Related U.S. Application Data

(60) Provisional application No. 60/371,378, filed on Apr. 10, 2002.

(51) Int. Cl.[7] ..... F42B 5/00

(52) U.S. Cl. ..... 102/470; 102/430; 102/202; 102/204

(58) Field of Search ..... 102/204, 470, 102/202, 469, 200, 202.5, 430–433, 467

(56) References Cited

U.S. PATENT DOCUMENTS

| | | | | | |
|---|---|---|---|---|---|
| 45,666 | A | * | 12/1864 | Yates | 102/470 |
| 2,446,187 | A | * | 8/1948 | Meister | 102/202 |
| 2,995,088 | A | * | 8/1961 | Asplund | 102/202 |
| 3,182,595 | A | * | 5/1965 | Hassmann | 102/202 |
| 3,750,581 | A | * | 8/1973 | Betts et al. | 102/380 |
| 4,674,405 | A | * | 6/1987 | Brede et al. | 102/202 |
| 4,938,146 | A | * | 7/1990 | Gunther et al. | 102/439 |
| 5,052,302 | A | * | 10/1991 | Taddeo et al. | 102/204 |
| 5,277,118 | A | * | 1/1994 | Conil | 102/431 |
| H1352 | H | * | 9/1994 | Bundy et al. | 102/202 |
| 5,465,665 | A | * | 11/1995 | Diehl | 102/470 |
| 5,767,439 | A | * | 6/1998 | Lindblom et al. | 102/472 |
| 5,895,881 | A | * | 4/1999 | Thiesen et al. | 102/202 |
| 6,272,994 | B1 | * | 8/2001 | Reider | 102/204 |
| 6,286,432 | B1 | * | 9/2001 | Reider | 102/470 |
| 6,450,099 | B1 | * | 9/2002 | Desgland | 102/431 |
| 6,543,363 | B2 | * | 4/2003 | Brion | 102/470 |
| 6,708,621 | B1 | * | 3/2004 | Forichon-Chaumet et al. | 102/470 |

* cited by examiner

*Primary Examiner*—Michael J. Carone
*Assistant Examiner*—James S. Bergin
(74) *Attorney, Agent, or Firm*—Hunton & Williams LLP

(57) ABSTRACT

A primer assembly including an ignition element assembly, a primer head assembly and a tubular body, is presented. The primer head assembly has an exterior diameter and an internal chamber containing the ignition element assembly. The tubular body has an open head end, a closed tail end and a wall defining an internal chamber. The internal chamber of the tubular body contains an ignition charge and the head end includes an internal diameter for receiving the exterior diameter of the primer head assembly. When the primer assembly is assembled, the tubular body encloses the primer head assembly and the primer head assembly seals the internal chamber. In one embodiment, the tubular body is a one-piece, seamless metallic tube having a wall of a thickness of about 0.150 to 0.160 inch and, preferably, about 0.155 inch.

33 Claims, 5 Drawing Sheets

PRIMER BODY

CROSS-REFERENCE TO RELATED APPLICATIONS

This patent application claims the benefit of U.S. Provisional Patent Application Ser. No. 60/371,378, entitled "PRIMER BODY" that was filed on Apr. 10, 2002, the disclosure of which is incorporated by reference in its entirety as if fully set forth herein.

BACKGROUND OF THE INVENTION

1. Field of the Invention

The present invention relates generally to primer assemblies and, more particularly, to an improved bayonet type primer assembly for medium caliber ammunition.

2. Discussion of the Prior Art

Bayonet type primer assemblies have been used for many years in ignition systems of medium caliber ammunition, such as ammunition that is fired from a fighting vehicle. For example, tank ammunition comprises a 120 mm cartridge that includes a primer assembly threaded into the base of a cartridge case. The primer assembly is embedded into a propelling charge that is contained within the cartridge case in proximity to a projectile.

The primer assembly typically includes a primer head and a tubular body portion having an open end, a closed end, an interior chamber and flash holes in a wall of the body. A pyrotechnic formulation such as a nitrocellulose and black powder formulation in a strand form (e.g., benite) is disposed within the chamber. The primer head is mounted externally to the tubular body to close the open end of the tubular body. The primer head assembly includes an ignition element that is located in proximity with the pyrotechnic formation when the primer head is mounted to the tubular body. When activated, the ignition element ignites the pyrotechnic formulation. Ignition flame from the pyrotechnic formulation passes through the flash holes and ignites the propellant charge within the cartridge case to propel the projectile out of the casing and a barrel of the vehicle. Two piece primer assemblies of this type are disclosed in commonly assigned U.S. Pat. No. 5,465,665, entitled "Primer", by Steven F. Diehl, issued Nov. 14, 1995, and U.S. Pat. No. 5,052,302, entitled "Unpressurized Combustible Primer For Cannon Cartridges", by Ralph M. Taddeo et al., issued Oct. 1, 1991. The disclosures of these U.S. patents are incorporated by reference herein in their entireties.

Most conventional primer assemblies include metallic components. During the ignition process the metallic components become extremely hot, for example, the surface temperature of the components exceeds the ignition temperatures of combustible components of the 120 mm ammunition. After ignition, the cartridge case including the primer assembly is ejected into the confines of the fighting vehicle. The ejected hot metallic components present a serious potential hazard to personnel within the fighting vehicle. For example, the ejected hot metallic components may contact an ammunition round that was being held ready for loading, or the ejected components may land on a next round stored in the vehicle and start a fire within the close confines of the fighting vehicle.

The aforementioned U.S. patents describe solutions to the problem presented by the ejected hot metallic components within the confines of the fighting vehicle.

The inventor has realized that further improvements over the conventional arrangements may be achieved by employing an improved primer assembly having a tubular body that accepts a primer head and ignition element within an internal diameter. For example, the inventor has realized that conventional primer assembly configurations having the primer head mount externally on a tubular body have drawbacks both during assembly and in use. For example, external mounting of the primer head makes assembly unduly cumbersome as particular care is required to ensure that ignition components are properly aligned within the internal chamber of the tubular body. Additionally, the externally mounted primer head may become detached from the tubular body due to vibration from movement of the fighting vehicle or under the extreme temperature and pressure ignition conditions. The separation of the primer assembly components may result in damage to the barrel of the fighting vehicle upon firing and/or complicate loading of a next round as the separate, extremely hot components must be individually removed from the barrel. The inventor has realized that by incorporating the primer body, primer head and ignition element into a one-piece construction increases the capacity of the primer assembly to dissipate heat more efficiently and quicker. Accordingly, the inventor has realized that it is desirable for primer assemblies to have a tubular body that accepts a primer head and ignition element within an internal diameter.

OBJECTS OF THE INVENTION

Accordingly, it is an object of this invention to provide a bayonet type primer assembly having a tubular body that accepts a primer head and an ignition element within an internal diameter for improved assembly and use characteristics.

It is another object of the present invention to provide an improved bayonet type primer assembly including a tubular body portion for substantially enclosing a primer head and an ignition element within an internal diameter of the tubular body portion such that separation of the primer head, the ignition element and the tubular body during ignition is substantially eleiminated.

It is yet another object of the present invention to provide an improved bayonet type primer assembly including a tubular body portion constructed to quickly dissipate heat applied to the body portion during ignition.

Further objects of this invention will become more apparent from a consideration of the drawings and ensuing description.

SUMMARY OF THE INVENTION

The foregoing objects are realized by a primer assembly that includes an ignition element assembly, a primer head assembly and a tubular body. The primer head assembly has an exterior diameter and an internal chamber containing the ignition element assembly. The tubular body has an internal chamber, an open head end and a closed tail end. The internal chamber of the tubular body contains an ignition charge and the head end includes an internal diameter for receiving the exterior diameter of the primer head assembly. When the primer assembly is assembled, the tubular body encloses the primer head assembly and the primer head assembly seals the internal chamber.

In one embodiment, the tubular body is a one-piece, seamless metallic tube having a diameter of about 0.870 to 0.885 inch and, preferably, about 0.877 inch, and a wall of a thickness of about 0.150 to 0.160 inch and, preferably, about 0.155 inch.

In one embodiment of the primer assembly, the tubular body includes a plurality of perforations in the wall of the tubular body and the primer assembly includes a liner that is disposed within the internal chamber of the tubular body. The liner lines the internal surface of the wall of the tubular body, blocks the plurality of perforations and contains the ignition charge. The liner prevents moisture and other materials from adversely affecting the ignition charge.

In one embodiment, the primer head assembly includes an outer flange and the primer assembly includes an o-ring that is disposed about an external diameter of the primer head assembly. When the primer head assembly is disposed within the tubular body the o-ring, the primer head assembly and the liner cooperate to substantially seal the internal chamber of the tubular body.

In another embodiment of the present invention a primer assembly includes an ignition element assembly, a primer head assembly having an exterior diameter and an internal chamber containing the ignition element assembly and a tubular body having an internal chamber, an open head end and a closed tail end. The internal chamber of the tubular body contains an ignition charge and the head end includes an external diameter having a threaded portion for attaching the primer assembly to a cartridge casing. When the primer assembly is assembled, the primer head assembly is disposed within the internal chamber of the tubular body such that the ignition element assembly is adjacent to the ignition charge. When the tubular body is attached to the cartridge casing the tail end extends into a propellant charge contained within the cartridge casing.

BRIEF DESCRIPTION OF THE DRAWINGS

The above set forth and other features of the invention are made more apparent in the ensuing Detailed Description of the Preferred Embodiments when read in conjunction with the attached Drawings, wherein.

Identically labeled elements appearing in different ones of the above-described figures are intended to refer to the same elements but may not be referenced in the description for all figures.

DETAILED DESCRIPTION OF THE PREFERRED EMBODIMENTS

Figure 1:
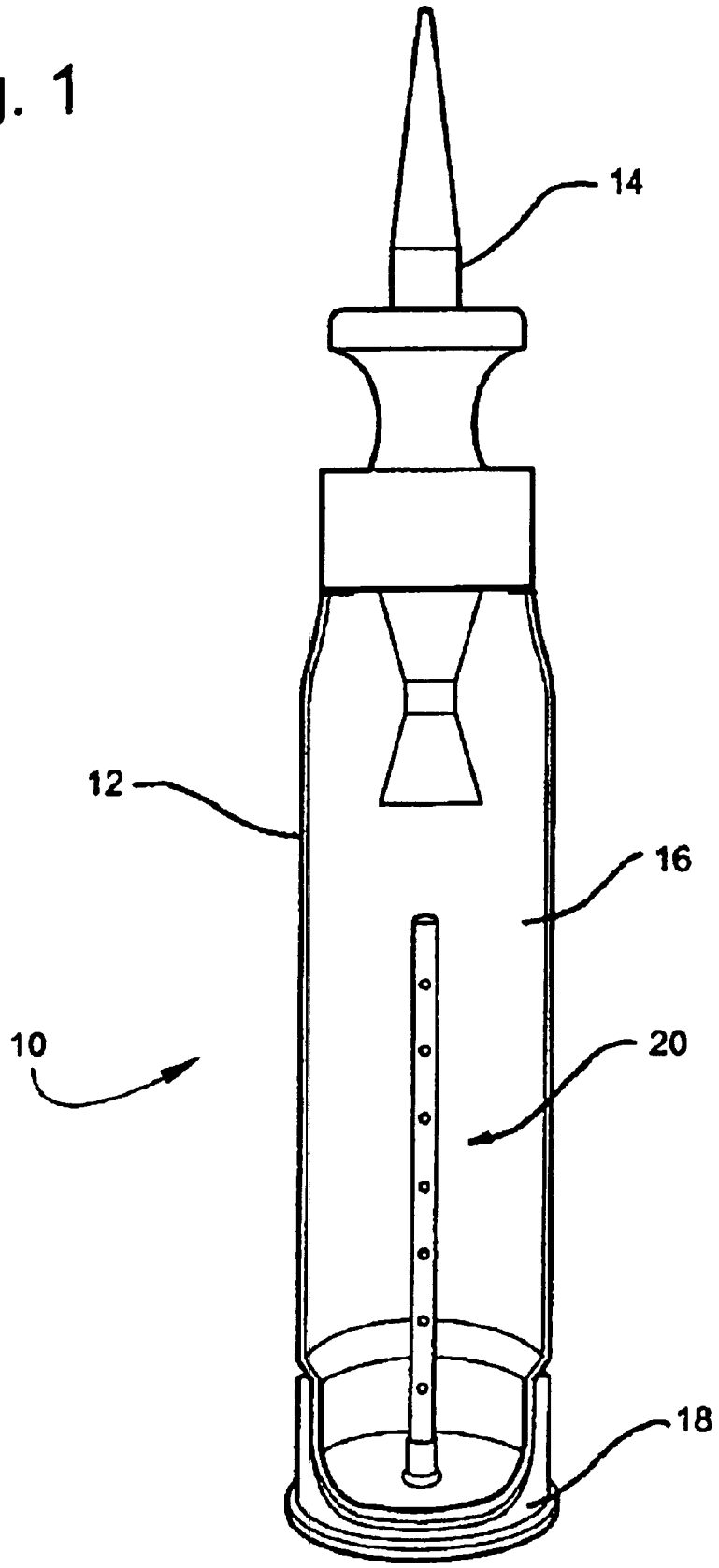
FIG. 1 is a cross-sectional view of a fighting vehicle ammunition cartridge configured in accordance with one embodiment of the present invention.

FIG. 1 illustrates, in a cross-sectional view, a medium caliber ammunition cartridge shown generally at 10 such as would be fired from a gun mounted on a fighting vehicle, for example, a tank. The cartridge 10 includes a cartridge case 12, a projectile 14 and a propellant charge 16 disposed in the case 12. The cartridge 10 also includes a primer assembly 20 mounted in a base 18 of the case 12.

Figure 2:
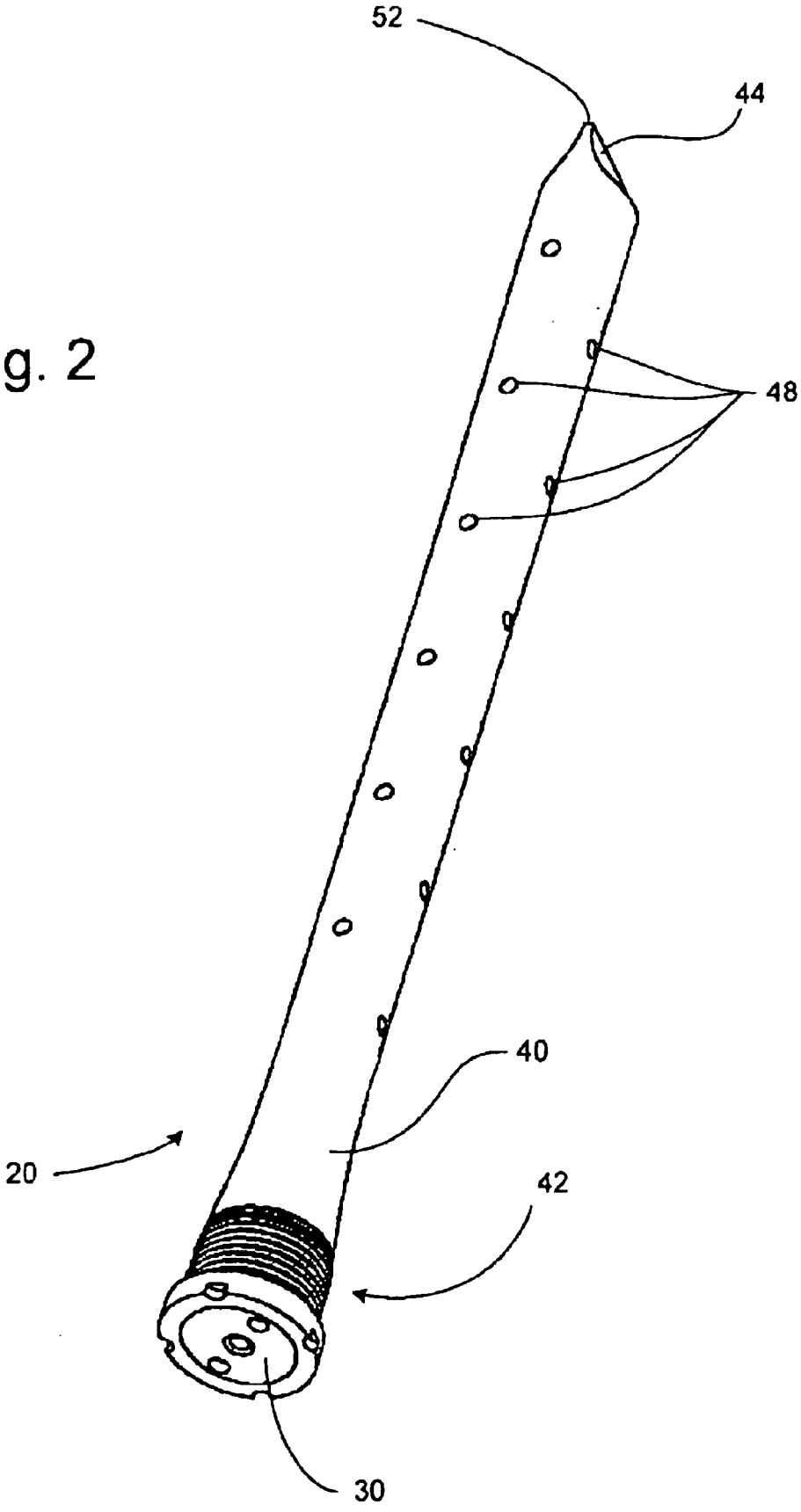
FIG. 2 is a perspective view of a bayonet primer assembly in accordance with one embodiment of the present invention.
Figure 3:
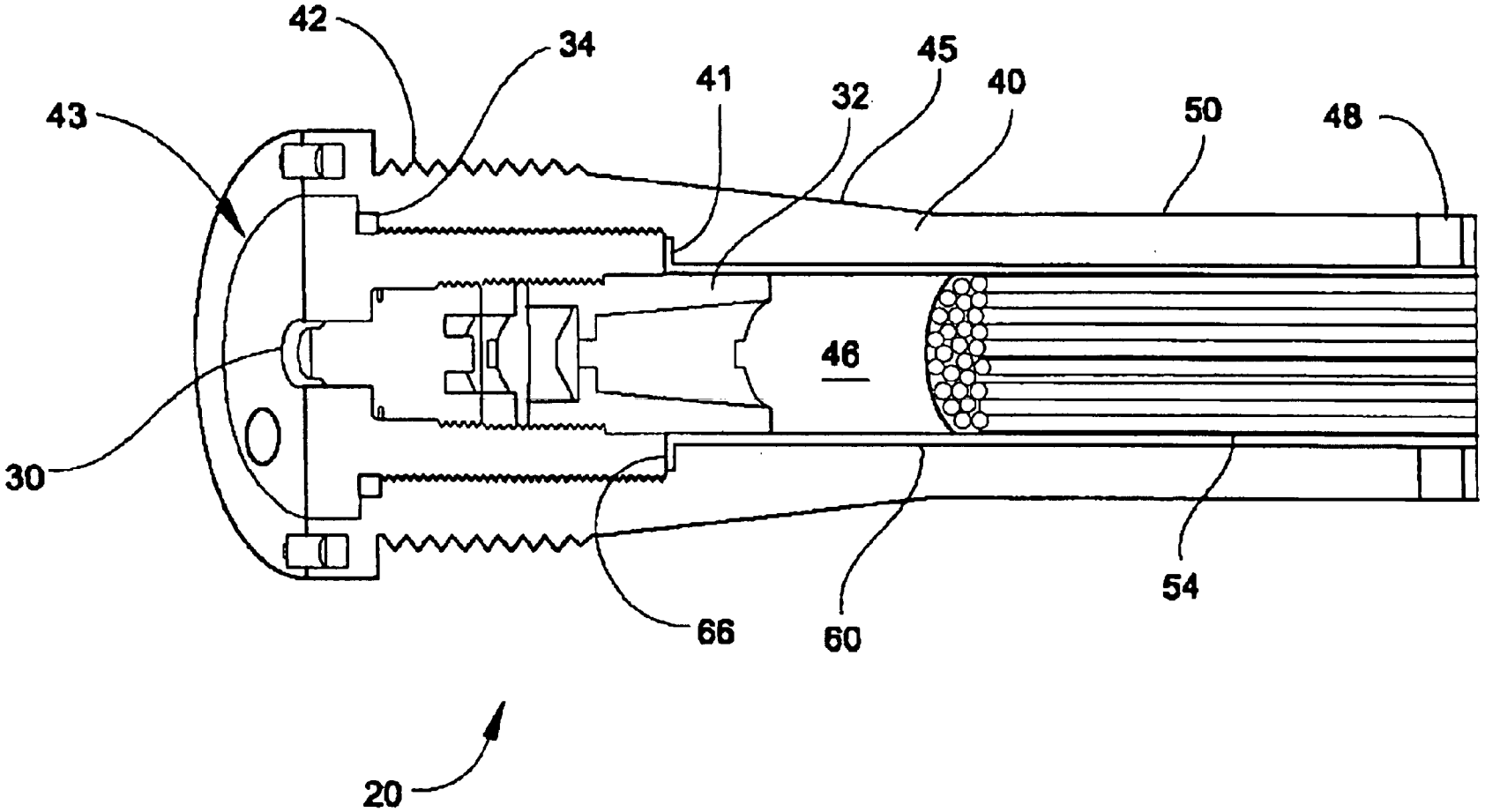
FIG. 3 is a partial cross-sectional view of the bayonet primer assembly of FIG. 2 that illustrates the alignment of a primer head and ignition components within an internal diameter of a tubular body portion of a bayonet primer assembly.

FIGS. 2 and 3 show the primer assembly 20 in greater detail. The primer assembly 20 includes a primer head 30 and a tubular body portion 40. The tubular body portion 40 includes a head end shown generally at 42, a tail end shown generally at 44, an interior chamber shown generally at 46, and flash holes 48 in a wall 50 of the tubular body portion 40. A pyrotechnic formulation 54 such as, for example benite, is disposed within the interior chamber 46. In accordance with the present invention, the head end 42 includes an opening 43 having an internal diameter for receiving the primer head 30. When the primer head 30 is disposed within the opening 43, ignition elements 32 located within the primer head 30 are disposed in proximity with the pyrotechnic formulation 54 and the primer head 30 substantially closes the opening 43 and the interior chamber 46. The inventor has found that by enclosing the primer head 30 substantially within the opening 43 only one piece, e.g., the tubular body portion 40, lies within the propellant charge 16. Therefore, a separation of the primer head 30 and the tubular body 40 inside the cartridge 10 is eliminated.

In one embodiment, the primer head 30 is threadily mounted within the opening 43. It should be appreciated that it is within the scope of the present invention to employ other mounting mechanisms such as, for example, a press fit mounting of the primer head 30 within the opening 43 of the head end 42.

In the inventive configuration, the primer head 30 may be removed from the opening 43 of the tubular body 40 without detaching the tubular body 40 from the base 18 of the cartridge 10. Therefore, maintenance operations may be performed on the primer head 30 or ignition elements 32 without disturbing the placement of the tubular body 40 within the cartridge 10. Additionally, since the primer head 30 is disposed within the opening 43 of the tubular body 40 design changes can be made to the ignition elements 32 without affecting the mounting of the tubular body 40 to the cartridge 10.

Figure 4:
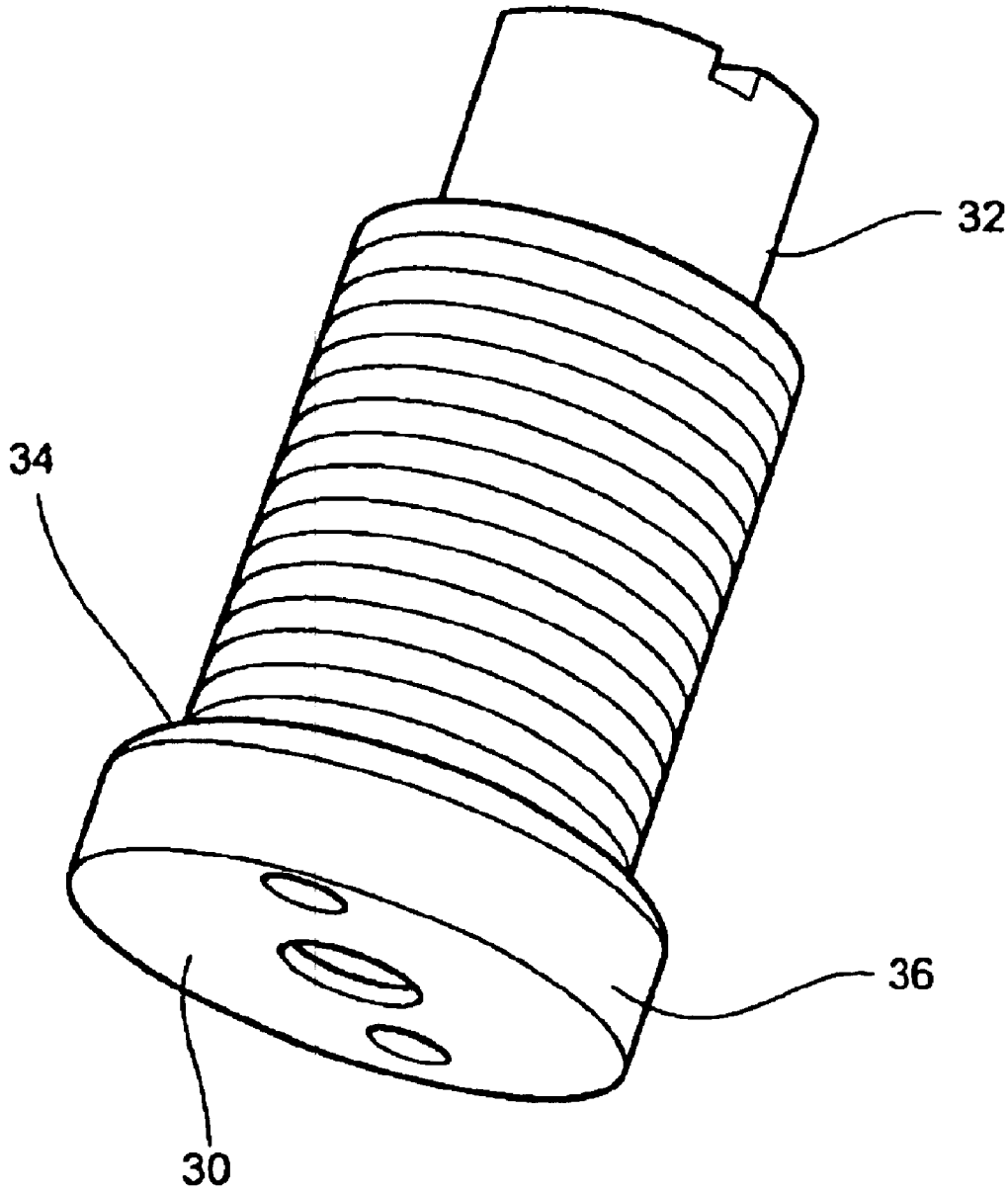
FIG. 4 is a perspective view of the primer head and the ignition components of FIG. 3.

As shown in FIGS. 3 and 4, an o-ring 34 is mounted about an exterior diameter and rests against a flange 36 of the primer head 30. The o-ring 34 and primer head 30 cooperate to seal the opening 43 and the interior chamber 46 of the tubular body 40 and to prevent moisture and other elements from penetrating the interior chamber 46.

Figure 5:
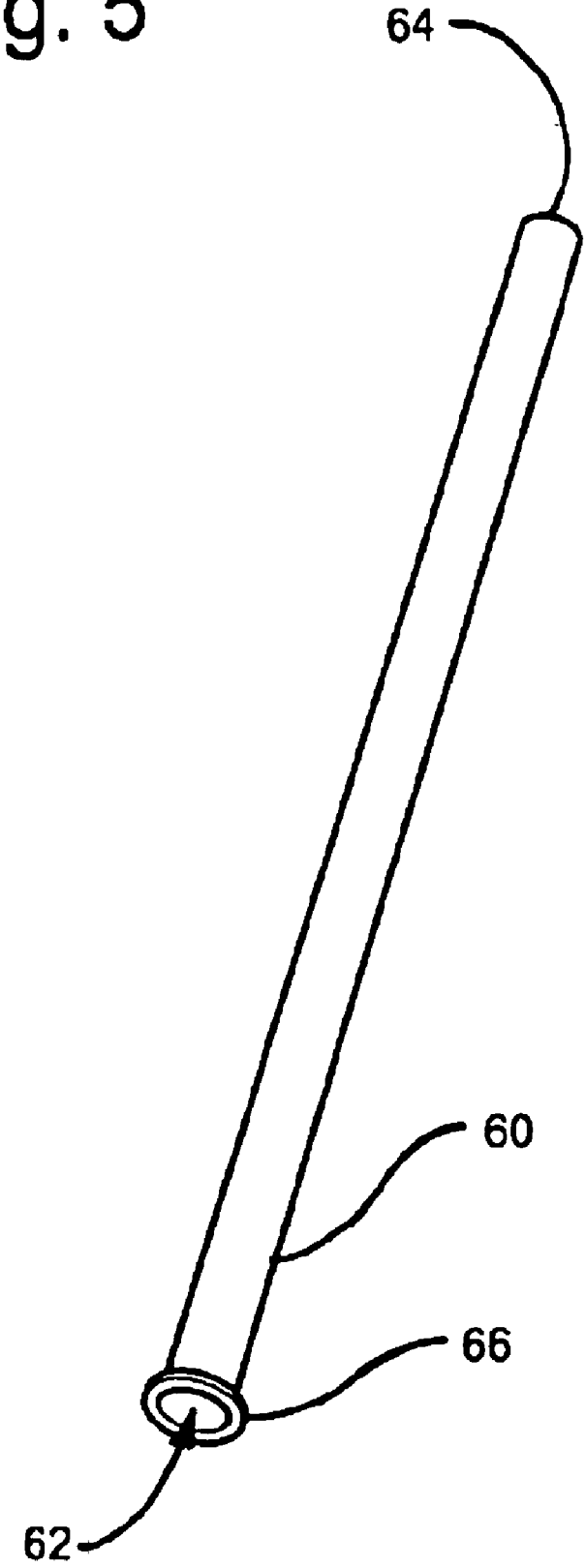
FIG. 5 is a perspective view of a liner for the tubular body portion of FIG. 3.

In one embodiment, a liner 60 is disposed within the interior chamber 46. As illustrated in FIG. 3, the liner 60 contains the pyrotechnic formulation 54 and lines inner surface of the wall 50 of the tubular body 40 to seal the flash holes 48. As shown in FIG. 5, the liner 60 includes an open end 62 and a closed end 64. Preferably, the open end 62 of the liner 60 includes a flange 66. When the liner 60 is disposed within the tubular body 40, the flange 66 rests against a seat 41 located on an interior diameter of the tubular body 40 (FIG. 3). The flange 66 is secured on the seat 41 when the primer head 30 is mounted in the opening 43 of the head end 42.

It should be appreciated that the liner 60, the primer head 30 and the o-ring 34 cooperate to form an air tight seal of the interior chamber 46 such that the pyrotechnic formulation 54 is protected from moisture or other foreign objects penetrating into the interior chamber 46. Additionally, the liner 60, the primer head 30 and the o-ring 34 cooperate during ignition to substantially prevent flareback and the escape of gases toward the breach of the barrel of the fighting vehicle.

In one embodiment, the liner 60 is comprised of a combustible polymeric material such as, for example, a polyethylene material. Preferably, the liner is comprised of a combustible polymeric material having an outside diameter of about 0.544 inch, a wall thickness of about 0.015 inch and a length of about 11.125 inches.

As noted above, the liner 60 encapsulates the pyrotechnic formulation 54. Additionally, the material that comprises the liner 60 is combustible such that, during ignition, the ignition flame defeats the material of the liner 60 and passes through the flash holes 48 to ignites the propellant charge 16.

Referring again to FIG. 2, in one embodiment, the tail end 44 of the tubular body 40 is tapered to form an elongated tip 52. Additionally, and as illustrated in FIG. 3, an exterior diameter, shown generally at 45, of the head end 42 is tapered. As the primer assembly 20 is mounted in the base 18 of the cartridge case 12, the elongated tip 52 and exterior diameter 45 push the propellant charge 16 aside so that the primer assembly 20 can be positioned within the case 12 without significant difficulty.

In one aspect of the invention the tubular body 40 is comprised of a one-piece, seamless metallic tube such as, for example, a steel tube. In one embodiment, the one-piece, seamless metallic tube is a carbon-based, cold finished steel such as 1215 and 12L14 in accordance with ASTM A108 (American Society for Testing and Materials). The metallic tube has a diameter of from about 0.870 to 0.885 inch, and preferably of about 0.877 inch and a wall 50 of a thickness of about 0.150 to 0.160 inch, and preferably about 0.155 inch. In another embodiment, the tubular body 40, the primer head 30 and/or other metallic components of the primer assembly 20 are comprised of 1010 steel machined, for example, from 1010 steel cold form extruded parts.

The inventor has found that the metallic tubular body 40 having the aforementioned wall thickness (e.g., the thickness of about 0.870 to 0.885 inch, and preferably of about 0.877 inch) acts as a heat sink and quickly dissipates high temperatures present during ignition. For example, the tubular body 40 is heated during ignition and the wall thickness is designed to dissipate the heat so as to minimize the surface temperature of the primer assembly as it is ejected from the barrel into the confines of the fighting vehicle.

Generally speaking, conventional "thin wall" metallic primer bodies have a wall thickness of about 0.060 to 0.070 inch while conventional thick wall primers have a tubular body with wall thickness greater than 0.070 inch but also have primer heads externally mounting to the tubular body. It should be appreciated that the thick wall primer of the present invention (e.g., a primer having a tubular body with a wall of a thickness of about 0.155 inch and with a primer head and ignition elements disposed in an internal diameter) demonstrate improvements over both conventional thin wall and thick wall primer bodies in dissipating heat from ignition.

It should be appreciated that the thick wall primer of the present invention does not inhibit the flame generated by ignition of the pyrotechnic formulation 54 from passing through flash holes 48 in the wall 50 of primer body 40 and igniting the propellant charge 16 disposed within the cartridge case 12.

While the invention has been described and illustrated in connection with preferred embodiments, many variations and modifications, as will be apparent to those of skill in the art, may be made without departing from the spirit and scope of the invention. By example, and as discussed above, the teachings of this invention are not intended to be limited to any specific ammunition, such as the 120 mm tank ammunition described above. That is, it should be appreciated that aspects of the present invention apply equally to other forms of ammunition where use of a metallic, one-piece primer body is desirable.

Accordingly, the invention as set forth in the appended clams is not limited to the precise details of construction set forth above as such other variations and modifications as would be apparent to one skilled in the art are intended to be included within the spirit and scope of the invention as set forth in the defined claims.

What is claimed is:

1. A primer assembly comprising:

a primer head assembly having a first internal chamber and a primer head face;

an ignition element assembly at least partially disposed within the first internal chamber of the primer head assembly;

a tubular body including a head end having an opening and an outer face, a closed end, and a second internal chamber defined by an inner wall;

an ignition charge disposed within the second internal chamber;

wherein the primer head assembly is fully disposed within the second internal chamber of the tubular body.

2. The primer assembly of claim 1, wherein said closed end of said tubular body is tapered to form an elongated tip.

3. The primer assembly of claim 1, wherein said head end of said tubular body is tapered.

4. The primer assembly of claim 1, wherein said tubular body is comprised of a one-piece seamless metallic tube.

5. The primer assembly of claim 4, wherein said metallic tube is comprised of steel.

6. The primer assembly of claim 4, wherein said metallic tube is comprised of a carbon-based cold finished steel.

7. The primer assembly of claim 4, wherein said metallic tube is comprised of a tube having an outside diameter of about 0.870 to 0.885 inch.

8. The primer assembly of claim 4, wherein said metallic tube is comprised of a tube having an outside diameter of about 0.877 inch.

9. The primer assembly of claim 4, wherein said metallic tube is comprised of a tube having a wall of a thickness of about 0.150 to 0.160 inch.

10. The primer assembly of claim 4, wherein said metallic tube is comprised of a tube having a wall of a thickness of about 0.155 inch.

11. The primer assembly of claim 1, wherein the primer head face and the outer face are substantially coplanar.

12. The primer assembly of claim 1, wherein the primer head assembly is effective to seal the second internal chamber.

13. The primer assembly of claim 1, wherein the primer head assembly is effective to seal the opening of the head end.

14. The primer assembly of claim 1, wherein the inner wall includes a plurality of perforations.

15. The primer assembly of claim 14, wherein the primer assembly further includes a liner disposed within the second internal chamber to block the plurality of perforations, said ignition charge disposed within the liner.

16. The primer assembly of claim 15, wherein the primer head assembly further includes an outer flange and an outer threaded surface, and wherein an O-ring is disposed about the outer threaded surface and seated against such outer flange.

17. The primer assembly of claim 16, wherein the primer head assembly, O-ring and liner cooperate to substantially seat the second internal chamber.

18. The primer assembly of claim 14, wherein activation of the ignition element assembly is effective to ignite the ignition charge which produces an ignition flame that travels through the plurality of perforations.

19. The primer assembly of claim 1, wherein the tubular body further includes an external threaded portion for removably attaching the primer assembly to a cartridge case.

20. The primer assembly of claim 1, wherein the primer head assembly is removably disposed within the second internal chamber of the tubular body.

21. The primer assembly of claim 1, wherein the primer head assembly is fully disposed within the second internal chamber of the tubular body such that the ignition element assembly is substantially adjacent to the ignition charge.

22. An ammunition cartridge comprising:

a cartridge case having a projectile portion, a base and an inner chamber;

a projectile mounted in the projectile portion;

a propellant charge disposed in the inner chamber of the cartridge case; and a primer assembly removably disposed in the base of the cartridge case, the primer assembly comprising:

a tubular body including a head end having an opening and an outer face, a closed end, and a second internal chamber defined by an inner wall;

a primer head assembly having a first internal chamber and a primer head face, the primer head assembly fully disposed within the second internal chamber of the tubular body;

an ignition element assembly at least partially disposed within the first internal chamber of the primer head assembly; and an ignition charge disposed within the second internal chamber of the tubular body.

23. The ammunition cartridge of claim 22, wherein the primer head face and the outer face are substantially coplanar.

24. The ammunition cartridge of claim 22, wherein the primer head assembly is effective to seal the second internal chamber.

25. The ammunition cartridge of claim 22, wherein the primer head assembly is effective to seal the opening of the head end.

26. The ammunition cartridge of claim 22, wherein the inner wall includes a plurality of perforations.

27. The ammunition cartridge of claim 26, wherein the primer assembly further includes a liner disposed within the second internal chamber to block the plurality of perforations, said ignition charge disposed within the liner.

28. The ammunition cartridge of claim 27, wherein the primer head assembly further includes an outer flange and an outer threaded surface, and wherein an O-ring is disposed about the outer threaded surface and seated against such outer flange.

29. The ammunition cartridge of claim 28, wherein the primer head assembly, O-ring and liner cooperate to substantially seal the second internal chamber.

30. The ammunition cartridge of claim 26, wherein activation of the ignition element assembly is effective to ignite the ignition charge which produces an ignition flame that travels through the plurality of perforations and ignites the propellant charge.

31. The ammunition cartridge of claim 22, wherein the tubular body further includes an external threaded portion for removably disposing the primer assembly in the base of the cartridge case.

32. The ammunition cartridge of claim 22, wherein the primer head assembly is removable from the second internal chamber of the tubular body without removing the tubular body from the base of the cartridge case.

33. The ammunition cartridge of claim 22, wherein the primer head assembly is removably disposed within the second internal chamber of the tubular body.

* * * * *